United States Patent [19]

Beland

[11] Patent Number: 5,056,125

[45] Date of Patent: Oct. 8, 1991

[54] DISCHARGE MODULE FOR X-RAY CABLE

[76] Inventor: Robert Beland, c/o Electromed Int'l Ltd., 310 Boul. Industriel, St. Eustache, Canada, J7R 5V3

[21] Appl. No.: 447,388

[22] Filed: Dec. 7, 1989

[51] Int. Cl.[5] ..... H05G 1/10

[52] U.S. Cl. ..... 378/101; 378/106; 378/117

[58] Field of Search ..... 378/106, 101, 110

[56] References Cited

U.S. PATENT DOCUMENTS 4,731,803 3/1988 Kranborg et al. ..... 378/106

*Primary Examiner*—Craig E. Church

*Attorney, Agent, or Firm*—Therese A. Hendricks; M. Lawrence Oliverio

[57] ABSTRACT

A discharge module positionable between a high-voltage power supply and an X-ray tube for discharging any capacitive voltage remaining on the cable connecting the same. The discharge module includes a low-voltage control portion which is optically coupled to a high-voltage portion that includes a switch for activating a discharging resistor series. The module also monitors the current through the X-ray tube to initiate a fault if the current exceeds a predetermined maximum.

5 Claims, 4 Drawing Sheets

DISCHARGE MODULE FOR X-RAY CABLE

BACKGROUND OF THE INVENTION

The present invention relates in general to an apparatus for powering X-ray tubes. More particularly, the invention relates to a discharge module for a cable connecting a high-voltage power supply and an X-ray tube which discharges any capacitive voltage remaining on the cable between X-ray exposure frames.

In a conventional X-ray tube, X-rays are produced by generating electrons by thermionic emission from a tungsten filament (cathode). The electrons are then accelerated to an anode (which may be rotating for wear averaging purposes) to generate the X-rays. The emission intensity of the tube is controlled by the filament current and by the high-voltage potential difference between the anode and cathode.

Precise control of the power supplied to an X-ray tube is important to insure proper imaging for diagnostic purposes and to avoid unnecessary exposure of the patient to X-ray radiation which does not produce a usable image. For example, when an X-ray tube is being used for applications such as cardiac angiography, the X-ray tube is operated in relatively short bursts at a relatively high frequency in order to obtain clear images and to be able to monitor heart activity and detect any abnormalities. Typically, the tube is operated at approximately 8 ms bursts. Where the X-ray image is to be recorded by a television camera, the exposure is further synchronized with the 60 Hz sweep rate of the TV camera so that a coherent picture is produced, i.e., at rates of 60, 30, 15 or 7.5 frames per second.

The relatively small X-ray tube current produced with pulsed fluroscopy does not sufficiently discharge the capacitance of the high-voltage cables connecting the power supply and X-ray tube between exposure frames. The "tail" on the power supply output waveform produces unwanted soft radiation which adds to the patient dose and does not improve the image. It would thus be desirable to provide a high-voltage power supply for an X-ray tube which produced substantially rectangular waveforms without a trailing tail of unwanted soft radiation.

SUMMARY OF THE INVENTION

This invention relates to a discharge module connected to the cable between a high-voltage power supply and an X-ray tube which discharges the capacitive voltage remaining on the cable between exposure frames.

The discharge module includes a high-voltage circuit portion and a low-voltage circuit portion, electrically isolated from one another, and transmitting and receiving means for sending a trigger signal from the low-voltage portion to the high-voltage portion. The high-voltage portion is coupled to the high-voltage cable and includes a resistor series and a switch for coupling the resistor series to the high-voltage cable. The low-voltage portion receives a control signal from the power supply which identifies the end of a high-voltage output pulse sent to the X-ray tube. The low-voltage portion then generates a trigger signal which is transmitted to the high-voltage portion to activate the switch and thereby couple the cable to the resistor series to discharge any remaining capacitive voltage on the cable.

A further feature of the invention is to provide fault detection if the X-ray tube current exceeds a predetermined maximum. Thus, the discharge module further monitors the current in the X-ray tube and if it exceeds a predetermined maximum, the exposure is terminated.

DETAILED DESCRIPTION OF THE PREFERRED EMBODIMENTS

Figures 1A, 1B:
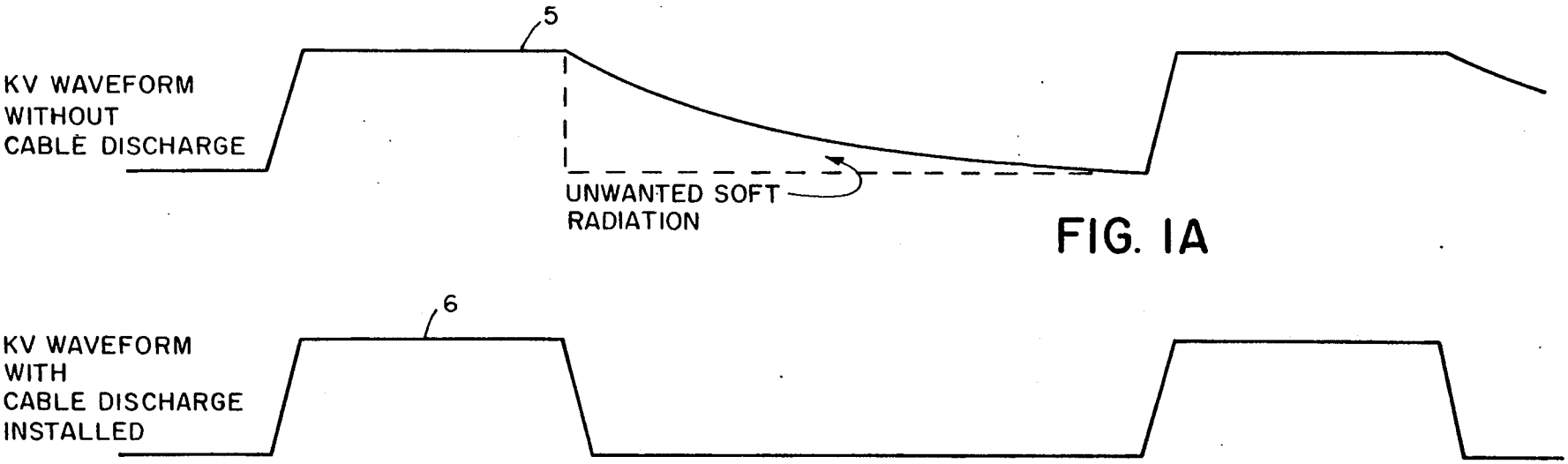
FIGS. 1A–1B are waveforms showing the voltage applied to the X-ray tube without and with the discharge module of this invention, respectively.
Figure 2:
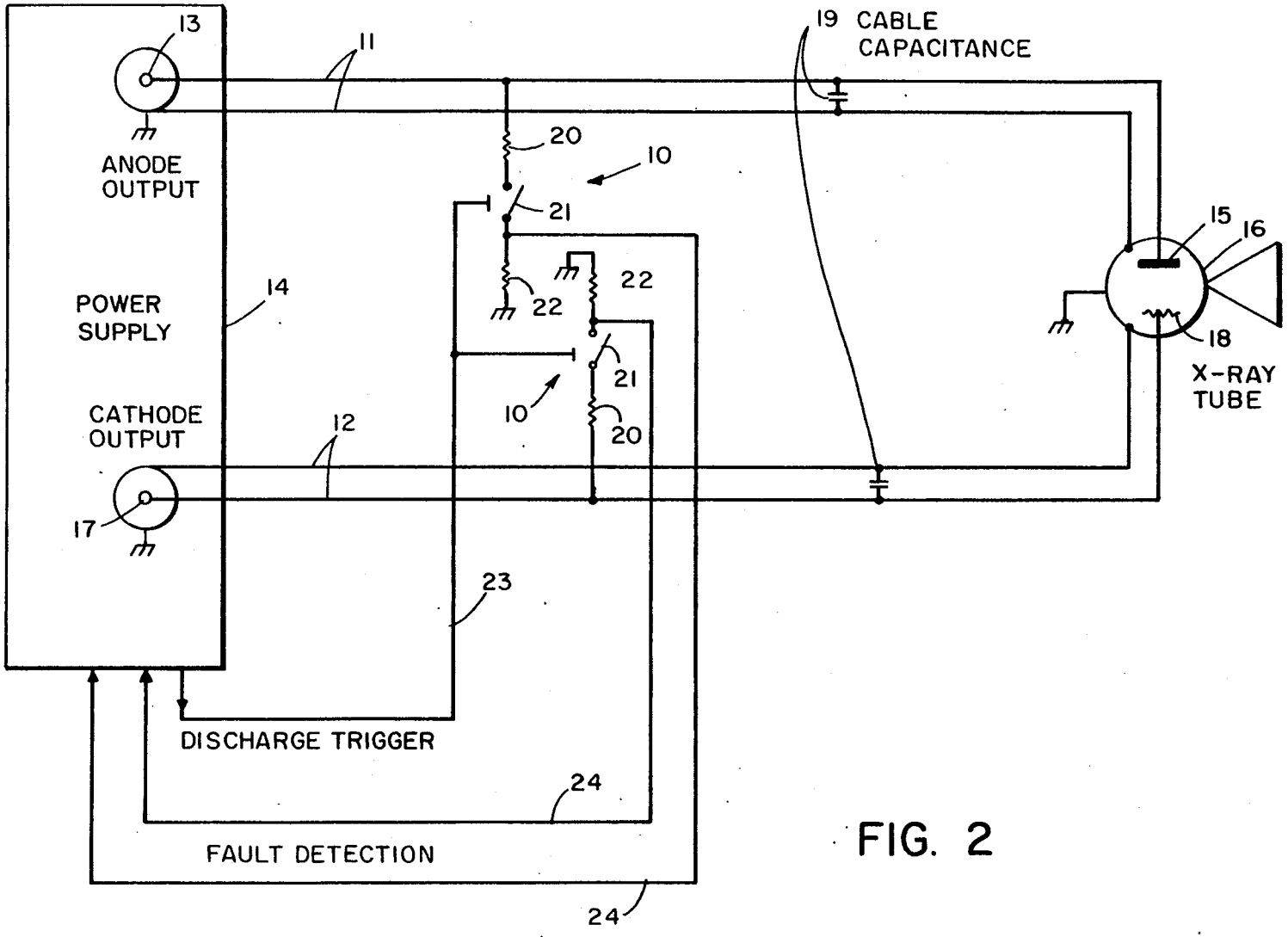
FIG. 2 shows two discharge modules of this invention disposed between a power supply and an X-ray tube.

There is now described an apparatus, and more particularly embodied in a circuit, for discharging capacitive voltage on a cable between a high-voltage power supply and an X-ray tube. The circuit 10 of the present invention, as illustrated in the block diagram of Fiq. 2, is connected to a high-voltage cable 11 connecting an anode output 13 of a power supply 14 and an anode 15 of an X-ray tube 16. An identical circuit is connected to a cable 12 connecting a cathode output 17 of the power supply and a cathode 18 of the X-ray tube. Each of the high-voltage cables 11, 12 includes two conductive leads, one of which is grounded. The cable capacitance 19 is shown schematically between the leads. Each circuit 10 includes a discharging resistor series 20, a switch 21, and a current-monitoring resistor 22 between the cable and ground. The switch 21 is activated by a discharge trigger signal sent on line 23 from a low-voltage control circuit in the power supply. The output of the current measuring resistor 22 is sent back to the control circuit on lines 24 for fault detection.

As shown in FIG. 1, the cable module is designed to eliminate the "tail" 7 on the output voltage waveform from the power supply which consists of unwanted soft radiation which adds to patient dosage, but does not improve the X-ray image. FIG. 1A shows a pulsed output signal 5 on a power supply without the discharge module of this invention, and FIG. 1B shows a substantially rectangular output waveform 6 with the discharge module employed.

As shown in Fiq. 2, a cable discharge module 10 is placed on cable 11 between the anode output of the power supply and ground, and a second module on cable 12 between the cathode output and ground. Typical high-voltage X-ray cables 11, 12 exhibit capacitance of about 500 pF per foot and are of a maximum length of about 100 feet. Fluroscopy is typically performed at a maximum of 125 kV (potential difference between anode and cathode) and at a frame rate of 60 images per second. The power dissipated by the cable discharge module is therefore:

$$\text{power} = \tfrac{1}{2}CV^2F$$

where C is the cable capacitance, V is the X-ray tube voltage, and F is the frame rate. In the particular embodiment described herein the power is: power $= \frac{1}{2}$ (500 pF)(125 kV)2 (60 frames/sec) = 586 watts, for each of the anode and cathode. The discharge modules remain in place during normal radiography and therefore must be able to withstand 75 kV per side. The module therefore comprises a 600 watt resistor in series with an 80 kV switch, along with the triggering and fault detecting circuitry described hereinafter.

Figure 3:
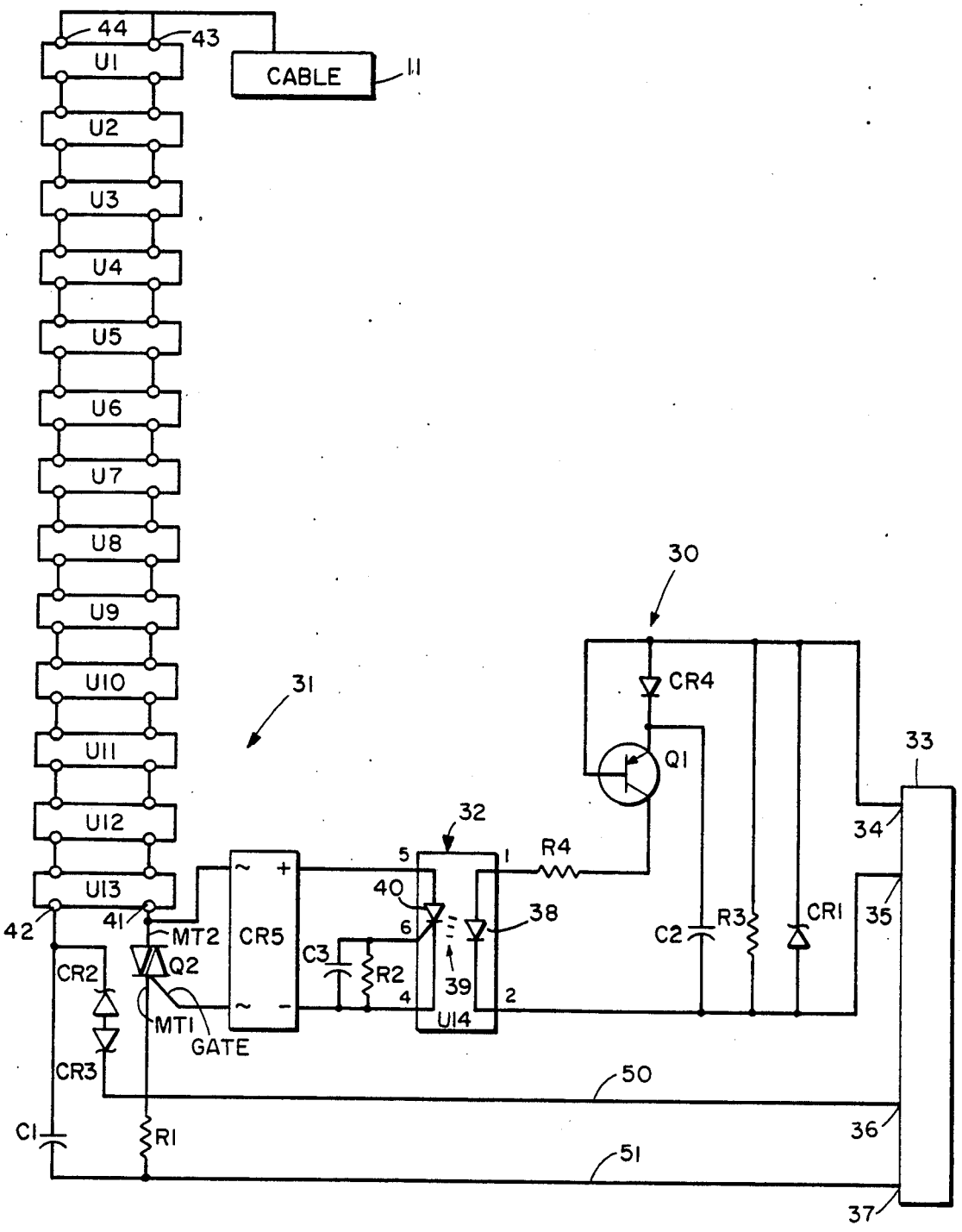
FIG. 3 is a more detailed diagram of one of the discharge modules of FIG. 2.
Figure 4:
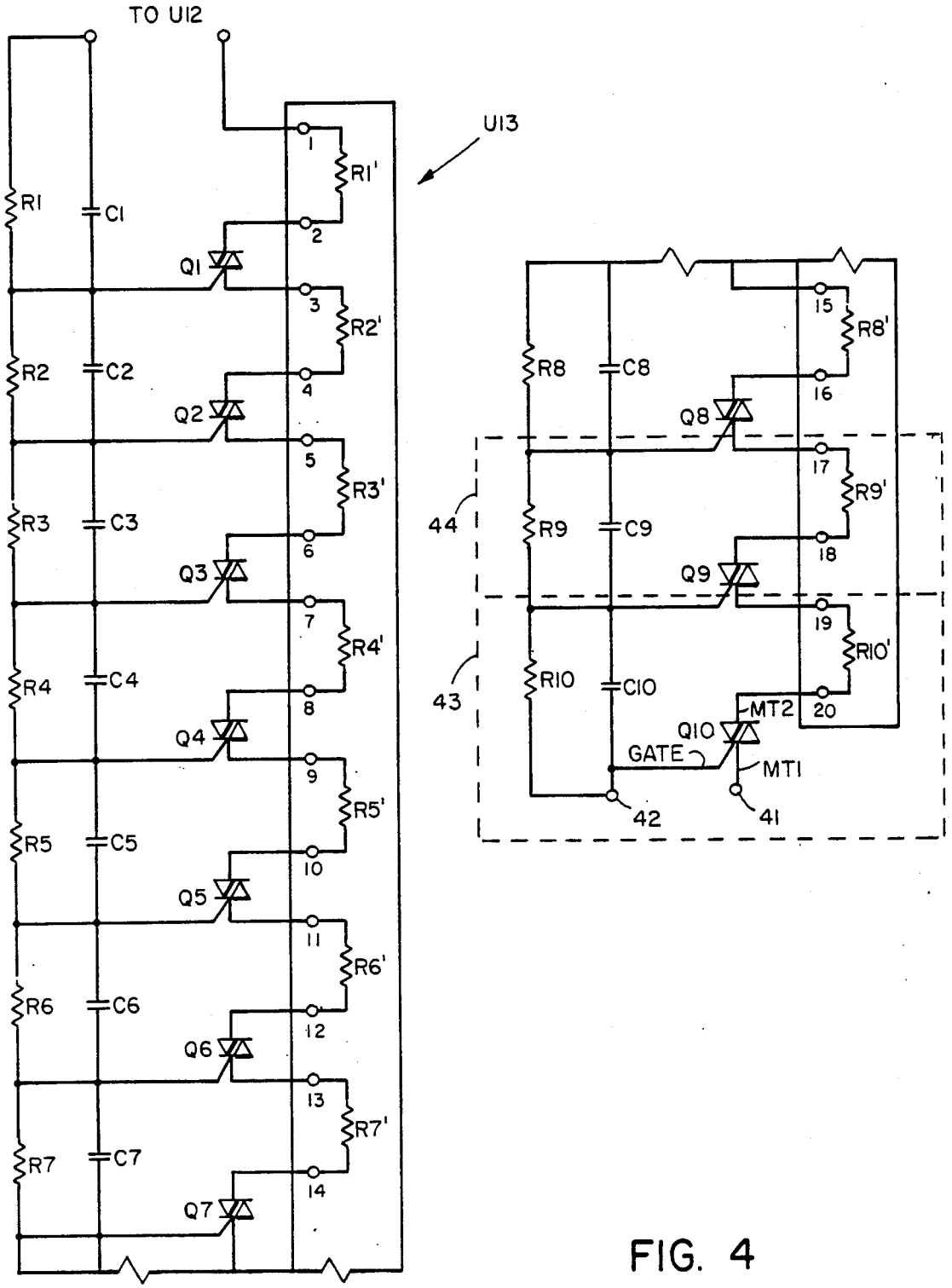
FIG. 4 is a detailed diagram of a portion of the triac resistor series used in the circuit of FIG. 3.

The energy dissipating resistor 20 consists of 10 thick film resistors screened onto each of 13 ceramic substrates. FIG. 3 shows the 13 substrates U1–U13 connected in series and FIG. 4 shows bottom substrate U13 having 10 thick film resistors R1'–R10' connected in series. When immersed in transformer oil, the 130 resistors R' are able to dissipate the required 5 watts each.

Each of the discharging resistors R' is part of a power dissipation stage. FIG. 4 shows a bottom power dissipation stage 43 on U13, which includes dissipating resistor R10', triac switch Q10', and control resistor and capacitor R10 and C10 connected in parallel with one another and with R10'. The ten stages on U13 are connected in series, with the discharging resistors R1'–R10' and their associated switches Q1–Q10 connected in series, and the control resistors and capacitors R1–R10 and C1–C10 also connected in series. The control resistors R1 to R10 in each power dissipation stage are in place to ensure a voltage balance among the 130 triacs.

As shown in FIG. 4, each of triacs Q1–Q10 has a breakdown voltage of 800 volts. Each substrate contains 10 triacs, and thus there are $800\times10=8000$ volts breakdown voltage per substrate. A minimum of 10 substrates is required to provide 80 kV breakdown voltage. Three extra substrates add $8000\times3=24$ kV of breakdown voltage protection to accommodate an imbalance in the applied voltage and as a margin for error in applied voltage.

As shown in FIG. 3, the discharge module consists essentially of three parts: 1) a low-voltage control circuit 30 which receives a trigger signal from the power supply; 2) a high-voltage circuit portion 31 including the resistor series, a switch Q2 for turning on the resistor series, and a resistor R1 for measuring the current in the X-ray tube; and 3) an optical transmission path 32 separating the low-voltage portion and the high-voltage portion.

The low-voltage portion 30 has an input terminal 34 connected to a low-voltage control circuit 33 in the power supply, and an output terminal 35 connected to the DC ground of the control circuit. During an X-ray exposure, between 10 and 100 milliamps of current passes from terminal 34 to terminal 35 and at the end of the exposure this current goes to zero. This current charges capacitor C2 through diode CR4 to about 5.5 volts. As long as more than about 1 milliamp is passing through resistor R3 and diode CRl, the base of transistor Q1 is held above its emitter and the transistor is off. At the end of the exposure, the base of transistor Q1 drops through resistor R3 while the emitter is held up by capacitor C2 and transistor Q1 is turned on, thereby transferring the energy of capacitor C2 into the LED 38 of optical isolator U14 through resistor R4. The light 39 emitted by the LED turns on the light activated silicon control rectifier (SCR) 40 of U14.

In the high-voltage portion 31 of the circuit, the voltage at upper terminal MT2 (main terminal 2) of transistor Q2 is positive when the discharge module is installed on the anode output, and negative when the discharge module is installed on the cathode output. In either case, however, a full wave bridge rectifier CR5 produces a positive DC voltage at the anode of the SCR in U14 and when the SCR 40 is turned on, Q2 will receive gate current and will turn on. Prior to Q2 turning on, the entire discharging resistor series U13–U1 is at the cable voltage because terminals 44, 45 on Ul are both connected to the high-voltage cable lead and Q2 is open so no current can flow through U13–U1. When Q2 is turned on, the energy in capacitor Cl is discharged through the gate/MTl junction of the bottom triac Q10 on U13, MT2/MTI of Q2, and R1, thus turning on the bottom power dissipation stage 43. The voltage drop at terminal 42 causes C10 to provide a voltage signal to the adjacent triac Q9, turning on Q9 and thus adjacent triac 44. Thus, by turning on only the bottom power dissipation stage of the chain U13–U1, the entire chain comes on and the residual cable capacitance voltage is dissipated in the 130 resistors R' of Ul U13. A series circuit is thus formed including Cl, the resistor chain on each of U13–U1, switch Q2 and resistor R1.

The voltage across the resistor R1 is proportional to the current in the resistor chain and is sensed by the control circuit 33 of the power supply during an X-ray exposure. Lines 50, 51 are connected across R1 and to terminals 36, 37 of the control circuit. If for any reason more than about 100 milliamps is sensed during an exposure, a fault is indicated and the output voltage is terminated to thereby terminate the exposure. The diodes CR2 and CR3 provide protection against high-voltage transients.

Having now described a limited number of embodiments of the present invention, it should be apparent to those skilled in the art that numerous other embodiments and modifications thereof are contemplated as falling within the scope of the present invention as defined in the appended claims.

What is claimed is:

1. Apparatus for discharging the capacitive voltage on a cable connecting a high-voltage power supply and an X-ray generating source, the apparatus comprising:

a discharge circuit including a high-voltage portion and a low-voltage portion, electrically isolated form one another, and means for transmitting a trigger signal between the high and low-voltage portions, the high-voltage portion including resistor means and switch means activated by the trigger signal for coupling that resistor means to the cable, the low-voltage portion including means for generating the trigger signal to activate the switch means and thereby couple the cable to the resistor means and discharge any capacitive voltage on the cable, and the high-voltage portion further including means for monitoring current int he resistor means and generating a fault signal for disabling the power supply if the current goes above a predetermined magnitude.

2. The apparatus of claim 1, wherein the resistor means comprises a plurality of resistors and switches serially connected for actively coupling the resistor means between the cable and ground.

3. The apparatus of claim 2, wherein activation of one of the switches sequentially activates the remaining switches and thus all resistors.

4. The apparatus of claim 3, wherein the means for generating and transmitting a trigger signal includes, on the low-voltage portion, means for receiving a control signal identifying the end of an X-ray exposure, a light-emitting means, and means responsive to the control signal for activating the light emitting means when an exposure ends, and further includes, on the high-voltage portion, means for receiving light from the light-emitting means and activating the switch means to couple the resistor means to the cable.

5. Apparatus for supplying operating power to an X-ray generating source comprising:

a power supply producing a plurality of pulsed high-voltage output signals for operating an X-ray generating source, the power supply including means for generating a low-voltage control signal which identifies the end of one of the output signals;

a cable for transmitting the output signals from the power supply to an X-ray generating source; and a discharge circuit connected to he cable for discharging any capacitive voltage remaining on the cable between output signals, the discharge circuit including a high-voltage portion and a low-voltage portion, electrically isolated from one another, and transmitting means on the low-voltage portion and receiving means on the high-voltage portion for transmitting a trigger signal between the high and low-voltage portions, the high-voltage portion including resistor means and switch means activated by the trigger signal for coupling the resistor means to the cable, the low-voltage portion including means for receiving the control signal and generating the trigger signal so as to activate the switch means to couple the cable to the resistor means and discharge any remaining capacitive voltage on the cable, and the high-voltage portion of the discharge circuit further including means or monitoring current on the cable and generating a fault signal if the current goes above a predetermined magnitude, and the power supply further including means for receiving the fault signal and terminating the output signals.

* * * * *